US005658847A

United States Patent [19]

Goss et al.

[11] Patent Number: 5,658,847

[45] Date of Patent: Aug. 19, 1997

[54] RECEIVER SHEET

[75] Inventors: Catherine Jane Goss, Middlesbrough; John Francis, Yarn; Charles Richard Hart, Middlesbrough; Karen Goodchild, Saltburn, all of United Kingdom

[73] Assignee: Imperial Chemical Industries PLC, England

[21] Appl. No.: 454,361

[22] PCT Filed: Jan. 25, 1994

[86] PCT No.: PCT/GB94/00137

§ 371 Date: Sep. 25, 1995

§ 102(e) Date: Sep. 25, 1995

[87] PCT Pub. No.: WO94/16903

PCT Pub. Date: Aug. 4, 1994

[30] Foreign Application Priority Data

Jan. 25, 1993 [GB] United Kingdom ..... 9301429

[51] Int. Cl.[6] ..... B41M 5/035; B41M 5/38

[52] U.S. Cl. ..... 503/227; 427/152; 428/195; 428/480; 428/500; 428/913; 428/914

[58] Field of Search ..... 8/471; 428/195, 428/480, 483, 913, 914, 500; 503/227; 427/152

[56] References Cited

U.S. PATENT DOCUMENTS

| | | | |
|---|---|---|---|
| 4,908,345 | 3/1990 | Egashira et al. | 503/227 |
| 5,236,886 | 8/1993 | Tsuchiya et al. | 503/227 |

FOREIGN PATENT DOCUMENTS

| | | |
|---|---|---|
| 0 429 179 A3 | 5/1991 | European Pat. Off. . |
| 0 429 179 A2 | 5/1991 | European Pat. Off. . |
| 0 466 336 A1 | 1/1992 | European Pat. Off. . |

*Primary Examiner*—Bruce H. Hess

[57] ABSTRACT

A thermal transfer printing receiver sheet for use in association with a compatible donor sheet, the receiver sheet comprising an opaque polyester supporting substrate having a deformation index, at a temperature of 200° C. and under a pressure of 2 megaPascals, of at least 4.0%, the substrate having, on a surface thereof, an adherent layer comprising an acrylic resin and having a coat weight within the range from 0.05 to 10 $mgdm^{-2}$, the adherent layer having, on a surface thereof remote from the substrate, a dye-receptive receiving layer to receive a dye thermally transferred from the donor sheet.

20 Claims, 1 Drawing Sheet

RECEIVER SHEET

This invention relates to thermal transfer printing and, in particular, to a thermal transfer printing receiver sheet for use with an associated donor sheet.

Currently available thermal transfer printing (TTP) techniques generally involve the generation of an image on a receiver sheet by thermal transfer of an imaging medium from an associated donor sheet. The donor sheet typically comprises a supporting substrate of paper, synthetic paper or a polymeric film material coated with a transfer layer comprising a sublimable dye incorporated in an ink medium usually comprising a wax and/or a polymeric resin binder. The associated receiver sheet usually comprises a supporting substrate, of a similar material, preferably having on a surface thereof a dye-receptive, polymeric receiving layer. When an assembly, comprising a donor and a receiver sheet positioned with the respective transfer and receiving layers in contact, is selectively heated in a patterned area derived, for example from an information signal, such as a television signal, dye is transferred from the donor sheet to the dye-receptive layer of the receiver sheet to form therein a monochrome image of the specified pattern. By repeating the process with different monochrome dyes, usually cyan, magenta and yellow, a full coloured image is produced on the receiver sheet. Image production, therefore depends on dye diffusion by thermal transfer.

Although the intense, localised heating required to effect development of a sharp image may be applied by various techniques, including laser beam imaging, a convenient and widely employed technique of thermal printing involves a thermal print-head, for example, of the dot matrix variety in which each dot is represented by an independent heating element (electronically controlled, if desired).

Available TTP print equipment has been observed to yield defective imaged receiver sheets comprising inadequately printed spots of relatively low optical density which detract from the appearance and acceptability of the resultant print. These small defective areas, conveniently referred to as micro-dots, are believed to result from poor conformation of the donor sheet the print-head at the time of printing. The quality of the print is also affected by the gloss and whiteness of the receiver sheet. Improved quality prints could be achieved by using very white receiver sheets, which would provide a background to enhance the printed colours.

There can be difficulties in achieving adequate adhesion of the receiving layer to the substrate. Adhesion can be achieved, for example when employing thermoplastic polymeric materials, by coextrusion of the respective film-forming layers. However, coextrusion is a relatively complex technology, and there is limit to the types of receiving layers that can be suitably coextruded. Alternatively, adhesion can be achieved by pretreating the substrate, eg by etching with suitable organic solvents, prior to coating the receiving layer. The aforementioned organic solvent treatments can be considered to be undesirable due to the evolution of flammable and/or toxic vapours.

We have now devised a receiver sheet for use in a TTP process which reduces or substantially eliminates at least one or more of the aforementioned problems.

Accordingly, the present invention provides a thermal transfer printing receiver sheet for use in association with compatible donor sheet, the receiver sheet comprising an opaque supporting substrate having a deformation index, at a temperature of 200° C. and under a pressure of 2 megaPascals, of at least 4.0%, the substrate having, on a surface thereof, an adherent layer comprising an acrylic resin, the adherent layer having, on a surface thereof remote from the substrate, a dye-receptive receiving layer to receive a dye thermally transferred from the donor sheet.

The invention also provides a method of producing a thermal transfer printing receiver sheet for use in association with a compatible donor sheet, which comprises forming an opaque supporting substrate having a deformation index, at a temperature of 200° C. and under a pressure of 2 megaPascals, of at least 4.0%, providing on a surface of the substrate, an adherent layer comprising an acrylic resin, and providing on a surface of the adherent layer remote from the substrate, a dye-receptive receiving layer to receive a dye thermally transferred from the donor sheet.

In the context of the invention the following terms are to be understood as having the meanings hereto assigned:

- sheet: includes not only a single, individual sheet, but also a continuous web or ribbon-like structure capable of being sub-divided into a plurality of individual sheets.
- compatible: in relation to a donor sheet, indicates that the donor sheet is impregnated with a dyestuff which is capable of migrating, under the influence of heat, into, and forming an image in, the receiving layer of a receiver sheet placed in contact therewith.
- opaque: means that the substrate of the receiver sheet is substantially impermeable to visible light.
- voided: indicates that the substrate of the receiver sheet preferably comprises a cellular structure containing at least a proportion of discrete, closed cells.
- film: is a self-supporting structure capable of independent existence in the absence of a supporting base.
- deformation index: is the deformation, expressed as a percentage of the original thickness of the substrate sheet, observed when the substrate sheet is subjected, at a temperature of 200° C., to a pressure of 2 megsPascals applied normal to the plane of the sheet by the hereinafter described test procedure (calculating the average value of five measurements).

The aforementioned deformation index test procedure is designed to provide conditions approximately equivalent to those encountered by a receiver sheet at the thermal print-head during a TTP operation. The test equipment comprises a thermomechanical analyser, Perkin Elmer, type TMA7, with a test probe having a surface area of 0.785 $mm^2$.

A sample of the substrate, for example—a biaxially oriented polyethylene terephthalate film of 175 μm thickness, is introduced in a sample holder into the TMAY7 furnace and allowed to equilibrate at the selected temperature of 200° C. The probe is loaded to apply a pressure of 0.125 megaPascals normal to the planar surface of the hot film sample and the deformation is observed to be zero. The load on the probe is then increased whereby a pressure of 2 megaPascals is applied to the sample. The observed displacement of the probe under the increased load is recorded and expressed as a percentage of the thickness of the undeformed hot sample (under 0.125 megaPascals pressure). That percentage is the Deformation Index (DI) of the tested substrate material. The procedure is repeated four times with different samples of the same film, and an average value of five measurements is calculated.

The substrate of a receiver sheet according to the invention may be formed from any synthetic, film-forming, polymeric material. Suitable thermoplastics, synthetic, materials include a homopolymer or a copolymer of a 1-olefine, such as ethylene, propylene or butene-1, a polyamide, a polycarbonate, and particularly a synthetic linear polyester which may be obtained by condensing one or more dicarboxylic acids or their lower alkyl (up to 6 carbon atoms) diesters, eg terephthalic acid, isophthalic acid, phthalic acid, 2,5-, 2,6- or 2,7- naphthalenedicarboxylic acid, succinic acid, sebacic acid, adipic acid, azelaic acid, 4,4'- diphenyldicarboxylic acid, hexahydro-terephthalic acid or 1,2-bis-p-carboxyphenoxyethane (optionally with a monocarboxylic acid, such as pivalic acid) with one or more glycols, eg ethylene glycol, 1,3-propanediol, 1,4-butanediol, neopentyl glycol and 1,4-cyclohexanedimethanol. A polyethylene terephthalate or polyethylene naphthalate film is preferred. A polyethylene terephthalate film is particularly preferred, especially such a film which has been biaxially oriented by sequential stretching in two mutually perpendicular directions, typically at a temperature in the range 70° to 125° C., and preferably heat set, typically at a temperature in the range 150° to 250° C., for example—as described in British patent 838,708.

The substrate may also comprise a polyarylether or thio analogue thereof, particularly a polyaryletherketone, polyarylethersulphone, polyaryletheretherketone, polyaryletherethersulphone, or a copolymer or thioanalogue thereof. Examples of these polymers are disclosed in EP-A-1879, EP-A-184458 and U.S. Pat. No. 4,008,203. The substrate may comprise a poly(arylene sulphide), particularly poly-p-phenylene sulphide or copolymers thereof. Blends of the aforementioned polymers may also be employed.

Suitable thermoset resin substrate materials include addition—polymerisation resins—such as acrylics, vinyls, bis-maleimides and unsaturated polyesters, formaldehyde condensate resins—such as condensates with urea, melamine or phenols, cyanate resins, functionalised polyesters, polyamides or polyimides.

A film substrate for a receiver sheet according to the invention may be uniaxially oriented, but is preferably biaxially oriented by drawing in two mutually perpendicular directions in the plane of the film to achieve a satisfactory combination of mechanical and physical properties. Formation of the film may be effected by any process known in the art for producing an oriented polymeric film—for example, a tubular or flat film process.

In a tubular process simultaneous biaxial orientation may be effected by extruding a thermoplastics polymeric tube which is subsequently quenched, reheated and then expanded by internal gas pressure to induce transverse orientation, and withdrawn at a rate which will induce longitudinal orientation.

In the preferred flat film process a film-forming polymer is extruded through a slot die and rapidly quenched upon a chilled casting drum to ensure that the polymer is quenched to the amorphous state. Orientation is then effected by stretching the quenched extrudate in at least one direction at a temperature above the glass transition temperature of the polymer. Sequential orientation may be effected by stretching a flat, quenched extrudate firstly in one direction, usually the longitudinal direction, ie the forward direction through the film stretching machine, and then in the transverse direction. Forward stretching of the extrudate is conveniently effected over a set of rotating rolls or between two pairs of nip rolls, transverse stretching then being effected in a stenter apparatus. Stretching is effected to an extent determined by the nature of the film-forming polymer, for example—a polyester is usually stretched so that the dimension of the oriented polyester film is from 2.5 to 4.5 times its original dimension in the, or each direction of stretching.

A stretched film may be, and preferably is, dimensionally stabilised by heat-setting under dimensional restraint at a temperature above the glass transition temperature of the film-forming polymer but below the melting temperature thereof, to induce crystallisation of the polymer.

A film substrate for a receiver sheet according to the invention exhibits a Deformation Index (DI), as hereinbefore defined, of at least 4.0%. Elastic recovery of the deformed substrate is of importance in the production of TTP images of sharp definition and good contrast, and a preferred substrate exhibits a DI of not greater than about 50%. Preferably a receiver substrate exhibits a DI within a range of from 4.5% to 30%, and especially from 5% to 20%. Particularly desirable performance is observed with a DI of from 6% to 10%.

The required DI is conveniently achieved by incorporation into the substrate polymer of an effective amount of a dispersible polymeric softening agent. For example, the DI of a polyethylene terephthalate substrate may be adjusted to the required value by incorporation therein of an olefin polymer, such as a low or high density homopolymer, particularly polyethylene, polypropylene or poly-4-methylpentene-1, an olefin copolymer, particularly an ethylene-propylene copolymer, or a mixture of two or more thereof. Random, block or graft copolymers may be employed. Polypropylene is a particularly preferred polymeric softening agent.

Dispersibility of the aforementioned olefin polymer in a polyethylene terephthalate substrate may be inadequate to confer the desired characteristics. Preferably, therefore a dispersing agent is incorporated together with the olefin polymer softening agent. The dispersing agent conveniently comprises a grafted polyolefin copolymer or preferably a carboxylated polyolefin, particularly a carboxylated polyethylene.

The carboxylated polyolefin is conveniently prepared by the oxidation of an olefin homopolymer (preferably an ethylene homopolymer) to introduce carboxyl groups onto the polyolefin chain. Alternatively the carboxylated polyolefin may be prepared by copolymerising an olefin (preferably ethylene) with an olefinically unsaturated acid or anhydride, such as acrylic acid, maleic acid or maleic anhydride. The carboxylated polyolefin may, if desired, be partially neutralised. Suitable carboxylated polyolefins include those having a Brookfield Viscosity (140° C.) in the range 150–100000 cps (preferably 150–50000 cps) and an Acid Number in the range 5–200 mg KOH/g (preferably 5–50 mg KOH/g), the Acid Number being the number of mg of KOH required to neutralise 1 g of polymer.

The amount of dispersing agent may be selected to provide the required degree of dispersibility, but conveniently is within a range of from 0.05 to 50%, preferably from 0.5 to 20%, by weight of the olefin polymer softening agent.

An alternative polymeric softening agent, which may not require the presence of a polymeric dispersing agent, comprises a polymeric elastomer. Suitable polymeric elastomers include polyester elastomers such as a block copolymer of n-butyl terephthalate with tetramethylene glycol or a block copolymer of n-butyl terephthalate hard segment with an ethylene oxide-propylene oxide soft segment. Such polyester elastomeric block copolymers are particularly suitable for inclusion in an opaque substrate of the kind herein described.

The mount of incorporated polymeric softening agent is preferably within a range of from 0.5% to 50%, more preferably from 2.0% to 30%, particularly from 4% to 20%, and especially from 8% to 14% by weight of the total amount of polymeric material in the substrate.

The substrate according to the invention is opaque, preferably exhibiting a Transmission Optical Density (Sakura Densitometer; type PDA 65; transmission mode) of from 0.75 to 1.75, more preferably of from 0.8 to 1.4, particularly of from 0.85 to 1.2, and especially of from 0.9 to 1.1.

The polymeric softening agent preferably also functions as a voiding agent generating an opaque, voided substrate structure during any stretching operation employed in the production of the film. However, in a preferred embodiment of the invention the substrate comprises a polymeric softening agent and an additional opacifying agent, such as a particulate inorganic filler.

Particulate inorganic fillers suitable for generating an opaque substrate include conventional inorganic pigments and fillers, and particularly metal or metalloid oxides, such as alumina, silica and titania, and alkaline metal salts, such as the carbonates and sulphates of calcium and barium.

The particulate inorganic fillers my be of the voiding and/or non-voiding type. Suitable inorganic fillers may be homogeneous and consist essentially of a single filler material or compound, such as titanium dioxide or barium sulphate alone. Alternatively, at least a proportion of the filler may be heterogeneous, the primary filler material being associated with an additional modifying component. For example, the primary filler particle may be treated with a surface modifier, such as a pigment, soap, surfactant coupling agent or other modifier to promote or alter the degree to which the filler is compatible with the substrate polymer.

Titanium dioxide is a particularly preferred particulate inorganic filler.

Production of a substrate having satisfactory degrees of opacity, and preferably whiteness requires that the inorganic filler, particularly of titanium dioxide, should be finely-divided, and the average particle size thereof is desirably from 0.01 to 10 μm. Preferably, the filler has an average particle size of from 0.05 to 5 μm, more preferably of from 0.1 to 1 μm, and particularly of from 0.15 to 0.3 μm.

Particle sizes may be measured by electron microscope, coulter counter or sedimentation analysis and the average particle size may be determined by plotting a cumulative distribution curve representing the percentage of particles below chosen particle sizes.

It is preferred that none of the filler particles incorporated into the film substrate according to this invention should have an actual particle size exceeding 30 μm. Particles exceeding such a size may be removed by sieving processes which are known in the art. However, sieving operations are not always totally successful in eliminating all particles greater than a chosen size. In practice, therefore, the size of 99.9% by number of the particles should not exceed 30 μm. Most preferably the size of 99.9% of the particles should not exceed 20 μm.

The amount of inorganic filler, particularly of titanium dioxide, incorporated into the substrate desirably should be not less than 0.2% nor exceed 25% by weight, based on the weight of the substrate polymer. Particularly satisfactory levels of opacity are achieved when the concentration of filler is from about 0.5% to 10%, and especially from 1% to 4%, by weight, based on the weight of the total amount of polymeric material in the substrate.

In a preferred embodiment of the invention, the substrate comprises from 8% to 14% by weight of polypropylene and from 1% to 4% by weight of titanium dioxide, both based on the weight of the total amount of polymeric material in the substrate.

Incorporation of the polymeric softening agent and particulate inorganic filler into the polymer substrate may be effected by conventional techniques—for example, by mixing with the monomeric reactants from which the polymer is derived, or by dry blending with the polymer in granular or chip form prior to formation of a film therefrom.

Other additives, generally in relatively small quantities, may optionally be incorporated into the film substrate. For example, optical brighteners in amounts up to 1500 parts per million to promote whiteness, and dyestuffs in amounts of up to 10 parts per million to modify colour, the specified concentrations being by weight, based on the weight of the substrate polymer.

Thickness of the substrate may vary depending on the envisaged application of the receiver sheet but, in general, will not exceed 250 μm, will preferably be in a range from 50 to 190 μm, and more preferably be in a range from 150 to 190 μm.

By "acrylic resin" is meant a resin which comprises at least one acrylic and/or methacrylic component.

The acrylic resin component of the adherent layer of a receiver sheet according to the invention is preferably thermoset and preferably comprises at least one monomer derived from an ester of acrylic acid and/or an ester of methacrylic acid, and/or derivatives thereof. In a preferred embodiment of the invention, the acrylic resin comprises from 50 to 100 mole %, more preferably from 70 to 100 mole %, especially from 80 to 100 mole %, and particularly from 85 to 98 mole % of at least one monomer derived from an ester of acrylic acid and/or an ester of methacrylic acid, and/or derivatives thereof. A preferred acrylic resin for use in the present invention preferably comprises an alkyl ester of acrylic and/or methacrylic acid where the alkyl group contains up to ten carbon atoms such as methyl, ethyl, n-propyl, isopropyl, n-butyl, isobutyl, terbutyl, hexyl, 2-ethylhexyl, heptyl, and n-octyl. Polymers derived from an alkyl acrylate, for example ethyl acrylate and butyl acrylate, together with an alkyl methacrylate are preferred. Polymers comprising ethyl acrylate and methyl methacrylate are particularly preferred. The acrylate monomer is preferably present in the acrylic resin in a proportion in the range 30 to 65 mole %, and the methacrylate monomer is preferably present in a proportion in the range of 20 to 60 mole %.

Other monomers which are suitable for use in the preparation of the acrylic resin of the adherent layer, which may be preferably copolymerised as optional additional monomers together with esters of acrylic acid and/or methacrylic acid, and/or derivatives thereof, include acrylonitrile, methacrylonitrile, halo-substituted acrylonitrile, halo-substituted methacrylonitrile, acrylamide, methacrylamide, N-methylol acrylamide, N-ethanol acrylamide, N-propanol acrylamide, N-methacrylamide, N-ethanol methacrylamide, N-methyl acrylamide, N-tertiary butyl acrylamide, hydroxyethyl methacrylate, glycidyl acrylate, glycidyl methacrylate, dimethylamino ethyl methacrylate, itaconic acid, itaconic anhdyride and half esters of itaconic acid.

Other optional monomers of the acrylic resin adherent layer polymer include vinyl esters such as vinyl acetate, vinyl chloracetate and vinyl benzoate, vinyl pyridine, vinyl chloride, vinylidene chloride, maleic acid, maleic anhydride, styrene and derivatives of styrene such as chloro styrene, hydroxy styrene and alkylated styrenes, wherein the alkyl group contains from one to ten carbon atoms.

A preferred acrylic resin, derived from 3 monomers comprises 35 to 60 mole % of ethyl acrylate/30 to 55 mole % of methyl methacrylate/2–20 mole % of methacrylamide, and especially comprising approximate molar proportions 46/46/8% respectively of ethyl acrylate/methyl methacrylate/acrylamide or methacrylamide, the latter polymer being particularly effective when thermoset—for example, in the presence of about 25 weight % of a methylated melamine-formaldehyde resin.

A preferred acrylic resin, derived from 4 monomers comprises a copolymer comprising comonomers (a) 35 to 40 mole % alkyl acrylate, (b) 35 to 40 mole % alkyl methacrylate, (c) 10 to 15 mole % of a monomer containing a free carboxyl group, and (d) 15 to 20 mole % of a sulphonic acid and/or a salt thereof. Ethyl acrylate is a particularly preferred monomer (a) and methyl methacrylate is a particularly preferred monomer (b). Monomer (c) containing a than carboxyl group ie a carboxyl group other than those involved in any polymerisation reaction by which the copolymer may be formed, suitably comprises a copolymerisable unsaturated carboxylic acid, and is preferably selected from acrylic acid, methacrylic acid, maleic acid, and/or itaconic acid; with acrylic acid and itaconic acid being particularly preferred. The sulphonic acid monomer (d) may be present as the free acid and/or a salt thereof, for example as the ammonium, substituted ammonium, or an alkali metal, such as lithium, sodium or potassium, salt. The sulphonate group does not participate in the polymerisation reaction by which the adherent copolymer resin is formed. The sulphonic acid monomer preferably contains an aromatic group, and more preferably is p-styrene sulphonic acid and/or a salt thereof.

The weight average molecular weight of the acrylic resin can vary over a wide range but is preferably within the range 10,000 to 10,000,000, and more preferably within the range 50,000 to 200,000.

The acrylic resin preferably comprises at least 30% by weight of the layer and, more preferably, between 40% and 95%, particularly between 60% and 90%, and especially between 70% and 85% by weight of the coating layer. The acrylic resin is generally water-insoluble. The coating composition including the water-insoluble acrylic resin may nevertheless be applied to the film substrate as an aqueous dispersion. A suitable surfactant may be included in the coating composition in order to aid the dispersion of the acrylic resin.

If desired, the adherent layer coating composition may also contain a cross-linking agent which functions to cross-link the layer thereby improving adhesion to the substrate. Additionally, the cross-linking agent should preferably be capable of internal cross-linking in order to provide protection against solvent penetration. Suitable cross-linking agents may comprise epoxy resins, alkyd resins, amine derivatives such as hexamethoxymethyl melamine, and/or condensation products of an amine, eg melamine, diazine, urea, cyclic ethylene urea, cyclic propylene urea, thiourea, cyclic ethylene thiourea, alkyl melamines, aryl melamines, benzo guanamines, guanamines, alkyl guanamines and aryl guanamines, with an aldehyde, eg formaldehyde. A useful condensation product is that of melamine with formaldehyde. The condensation product may optionally be alkoxylated. The cross-linking agent may suitably be used in amounts in the range from 5% to 60%, preferably in the range from 10% to 40%, more preferably in the range from 15% to 30% by weight relative to the total weight of the adherent layer. A catalyst is also preferably employed to facilitate cross-linking action of the cross linking agent. Preferred catalysts for cross-linking melamine formaldehyde include para toluene sulphonic acid, maleic acid stabilised by reaction with a base, morpholinium paratoluene sulphonate, and ammonium nitrate.

The adherent layer coating composition my be applied before, during or after the stretching operation in the production of an oriented film. The adherent layer coating composition is preferably applied to the film substrate between the two stages (longitudinal and transverse) of a thermoplastics polyester film biaxial stretching operation. Such a sequence of stretching and coating is suitable for the production of an adherent layer coated linear polyester film, particularly polyethylene terephthalate film, substrate, which is preferably firstly stretched in the longitudinal direction over a series of rotating rollers, coated, and then stretched transversely in a stenter oven, preferably followed by heat setting.

The adherent layer coating composition is preferably applied to the substrate by any suitable conventional technique such as dip coating, bead coating, reverse roller coating or slot coating.

The adherent layer is preferably applied to the substrate at a coat weight within the range 0.05 to 10 $mgdm^{-2}$, especially 0.1 to 2.0 $mgdm^{-2}$. For films coated on both surfaces, each adherent layer preferably has a coat weight within the preferred range.

Prior to deposition of the adherent layer onto the substrate, the exposed surface thereof may, if desired, be subjected to a chemical or physical surface-modifying treatment to improve the bond between that surface and the subsequently applied adherent layer. A preferred treatment, because of its simplicity and effectiveness, is to subject the exposed surface of the substrate to a high voltage electrical stress accompanied by corona discharge.

When TTP is effected directly onto the surface of an adherent layer coated substrate as hereinbefore described, the optical density of the developed image tends to be low and the quality of the resultant film is generally inferior. A receiving layer is therefore required on the remote surface of the adherent layer and desirably exhibits (1) a high receptivity to dye thermally transferred from a donor sheet, (2) resistance to surface deformation from contact with the thermal print-head to ensure the production of an acceptably glossy print, and (3) the ability to retain a stable image.

A receiving layer satisfying the aforementioned criteria comprises a dye-receptive, synthetic thermoplastics polymer. The morphology of the receiving layer may be varied depending on the required characteristics. For example, the receiving polymer may be of an essentially amorphous nature to enhance optical density of the transferred image, essentially crystalline to reduce surface deformation, or partially amorphous/crystalline to provide an appropriate balance of characteristics.

The thickness of the receiving layer may vary over a wide range but generally will not exceed 50 μm. The dry thickness of the receiving layer governs, inter alia, the optical density of the resultant image developed in a particular receiving polymer, and preferably is within a range of from 0.5 to 25 μm. In particular, it has been observed that by careful control of the receiving layer thickness to within a range of from 0.5 to 10 μm, in association with an opaque substrate layer of the kind herein described, a surprising and significant improvement in resistance to surface deformation is achieved, without significantly detracting from the optical density of the transferred image.

A dye-receptive polymer for use in the receiving layer, and offering excellent adhesion to the adherent layer, suitably comprises a polyester resin, a polyvinyl chloride resin, or copolymers thereof such as a vinyl chloride/vinyl alcohol copolymer.

A suitable copolyester resin derived from one or more dibasic aromatic carboxylic acids, such as terephthalic acid, isophthalic acid and hexahydroterephthalic acid, and one or more glycols, such as ethylene glycol, diethylene glycol, triethylene glycol and neopentyl glycol. Typical copolyesters which provide satisfactory dye-receptivity and deformation resistance are those of ethylene terephthalate and ethylene isophthalate, especially in the molar ratios of from 50 to 90 mole % ethylene terephthalate and correspondingly from 50 to 10 mole % ethylene isophthlate. Preferred copolyesters comprise from 65 to 85 mole % ethylene terephthalate and from 35 to 15 mole % ethylene isophthalate.

Preferred commercially available amorphous polyesters include "Vitel PE200" (Goodyear) and "Vylon" polyester grades 103, 200 and 290 (Toyobo). Mixtures of different polyesters may be present in the receiving layer.

Formation of a receiving layer on the receiver sheet may be effected by conventional techniques—for example, by casting the polymer onto a preformed adherent layer coated substrate, followed by drying at an elevated temperature. The drying temperature can be selected to develop the desired morphology of the receiving layer. Thus, by effecting drying at a temperature below the crystalline melting temperature of the receiving polymer and permitting or causing the composite to cool, the receiving polymer will remain essentially crystalline. However, by drying at a temperature greater than the crystalline melting temperature of the receiving polymer, the latter will be rendered essentially amorphous. Drying of a receiver sheet comprising a polyester substrate and a copolyester receiving layer is conveniently effected at a temperature within a range of from 175° to 200° C. to yield a substantially crystalline receiving layer, or from 200° to 250° C. to yield an essentially amorphous receiving layer.

If desired, a receiver sheet according to the invention may additionally comprise an antistatic layer. Such an antistatic layer is conveniently provided on a surface of the substrate remote from the receiving layer. Although a conventional antistatic agent may be employed, a polymeric antistat is preferred. A particularly suitable polymeric antistat is that described in EP-0349152, the disclosure of which is incorporated herein by reference, the antistat comprising (a) a polychlorohydrin ether of an ethoxylated hydroxyamine and (b) a polyglycol diamine, the total alkali metal content of components (a) and (b) not exceeding 0.5% of the combined weight of (a) and (b).

A receiver sheet in accordance with the invention may, if desired, comprise a release medium present either within the receiving layer or, preferably as a discrete layer on at least part of the exposed surface of the receiving layer remote from the substrate.

The release medium, if employed, should be permeable to the dye transferred from the donor sheet, and comprises a release agent—for example, of the kind conventionally employed in TTP processes to enhance the release characteristics of a receiver sheet relative to a donor sheet. Suitable release agents include solid waxes, fluorinated polymers, silicone oils (preferably cured) such as epoxy- and/or amino-modified silicone oils, and especially organopolysiloxane resins. A particularly suitable release medium comprises a polyurethane resin comprising a poly dialkylsiloxane as described in EP-0349141, the disclosure of which is incorporated herein by reference.

The invention is illustrated by reference to the accompanying drawings in which.

Figure 1:
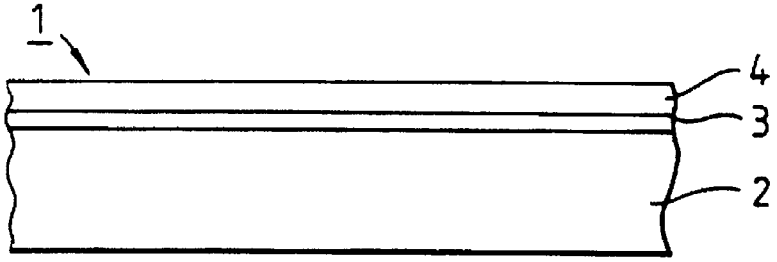
FIG. 1 is a schematic elevation (not to scale) of a portion of a TTP receiver sheet (1) comprising a polymeric supporting substrate (2) having, on a first surface thereof, an acrylic adherent layer (3) having, on a remote surface thereof, a dye-receptive receiving layer (4).
Figure 2:
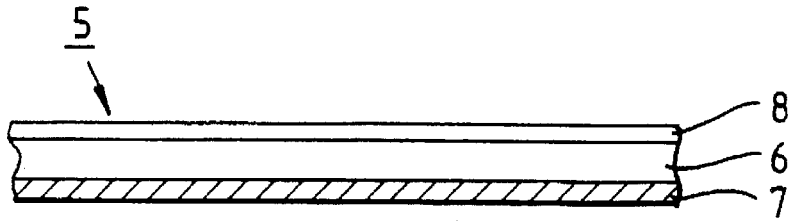
FIG. 2 is a schematic, fragmentary elevation (not to scale) of a compatible TTP donor sheet (5) comprising a polymeric substrate (6) having on one surface (the front surface) thereof a transfer layer (7) comprising a sublimable dye in a resin binder, and on a second surface (the rear surface) thereof a polymeric protective layer (8).
Figure 3:
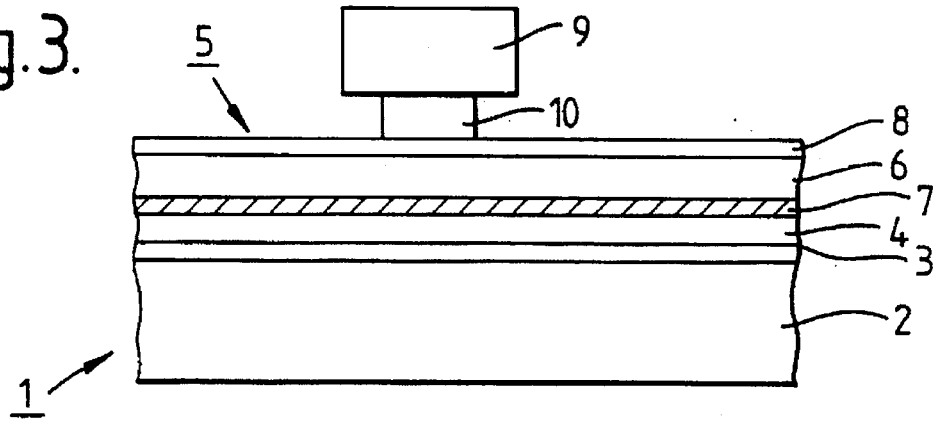
FIG. 3 is a schematic elevation of a TTP process.
Figure 4:
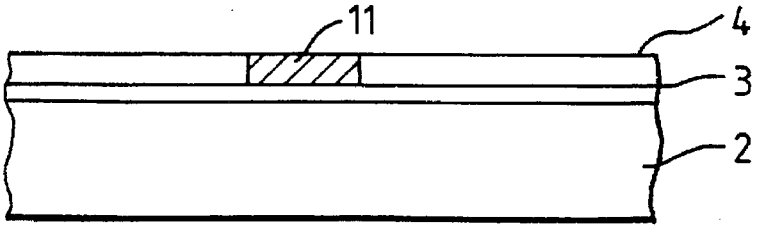
FIG. 4 is a schematic elevation of an imaged receiver sheet.

Referring to the drawings, and in particular to FIG. 3, a TTP process is effected by assembling a donor sheet and a receiver sheet with the respective transfer layer (7) and receiving layer (4) in contact. An electrically-activated thermally print-head (9) comprising a plurality of print elements (only one of which is shown (10)) is then placed in contact with the protective layer of the donor sheet. Energisation of the print-head causes selected individual print-elements (10) to become hot, thereby causing dye from the underlying region of the transfer layer to sublime into receiving layer (4) where it forms an image (11) of the heated element(s). The resultant imaged receiver sheet, separated from the donor sheet, is illustrated in FIG. 4 of the drawings.

By advancing the door sheet relative to the receiver sheet, and repeating the process, a multi-colour image of the desired form may be generated in the receiving layer.

The invention is further illustrated by reference to the following Examples.

EXAMPLE 1

A polyethylene terephthalate substrate containing 12% by weight of polypropylene, based on the weight of the total amount of polymeric material in the substrate, and 2% by weight of titanium dioxide filler of average particle size of 0.18 μm, based on the weight of the total amount of polymeric material in the substrate, was melt extruded, cast onto a cooled rotating drum and stretched in the direction of extrusion to approximately 3.5 times its original dimensions. The monoaxially oriented polyethylene terephthalate substrate film was coated on one side with an adherent layer coating composition comprising the following ingredients:

| | |
|---|---|
| Acrylic resin (46% w/w aqueous latex of methyl methacrylate/ethyl acrylate/methacrylamide: 46/46/8 mole %, with 25% by weight methoxylated melamine-formaldehyde) | 163 ml |
| Ammonium nitrate (10% w/w aqueous solution) | 12.5 ml |
| Synperonic NDB (13.7% w/w aqueous solution of a nonyl phenol ethoxylate, supplied by ICI) | 30 ml |
| Demineralised water | to 2.5 litres |

The adherent layer coated film was passed into a stenter oven, where the film was stretched in the sideways direction to approximately 3.5 times its original dimensions. The adherent layer coated biaxially stretched film was heat set at a temperature of about 220° C. by conventional means. A polyester receiving layer was coated directly on to the surface of the acrylic adherent layer to form the receiver sheet. Final film thickness was 175 μm. The dry coat weight of the adherent layer was approximately 0.4 $mgdm^{-2}$ and the thickness of the adherent layer was approximately 0.04 μm.

The substrate of the receiver sheet exhibited a Deformation Index (DI), measured as hereinbefore described, of 8%. The substrate also had a Transmission Optical Density (TOD), measured as hereinbefore described, of 1.0.

The adhesion of the polyester receiving layer to the acrylic adherent layer was tested using a standard cross-hatch adhesion test and found to be excellent.

The printing characteristics of the receiver sheet were assessed using a donor sheet comprising a biaxially oriented polyethylene terephthalate substrate of about 6 μm thickness having on one surface thereof a transfer layer of about 2 μm thickness comprising a magenta dye in a cellulosic resin binder.

A sandwich comprising a sample of the donor and receiver sheets with the respective transfer and receiving layers in contact was placed on the rubber covered drum of a thermal transfer printing machine and contacted with a print head comprising a linear array of pixcels spaced apart at a linear density of 6/mm. On selectively heating the pixcels in accordance with a pattern information signal to a temperature of about 350° C. (power supply 0.32 watt/pixcel) for a period of 10 milliseconds (ms), magenta dye was transferred from the transfer layer of the donor sheet to form a corresponding image of the heated pixcels in the receiving layer of the receiver sheet.

After stripping the transfer sheet from the coated film, the band image on the latter was assessed visually, and a significant reduction in printing flaws (unprinted spots or areas of relatively low optical density) was observed in comparison to a receiver sheet produced as described above, except that the polyethylene terephthalate substrate layer had a DI of 3.0%, and contained 18% by weight of barium sulphate of average particle size 0.5 μm instead of polypropylene and titanium dioxide.

EXAMPLE 2

This is a comparative example not according to the invention. The procedure of Example 1 was repeated except that the acrylic adherent layer was omitted. The adhesion of the polyester receiving layer to the polyethylene terephthalate substrate was tested using the same standard cross-hatch adhesion test used in Example 1, and found to be poor.

The above examples illustrate the improved properties of a receiver sheet according to the present invention.

We claim:

1. A thermal transfer printing receiver sheet for use in association with a compatible donor sheet, the receiver sheet comprising an opaque polyester supporting substrate having a deformation index, at a temperature of 200° C. and under a pressure of 2 megaPascals, of at least 4.0%, the substrate having, on a surface thereof, an adherent layer comprising an acrylic resin and having a coat weight within the range from 0.05 to 10 $mgdm^{-2}$, the adherent layer having, on a surface thereof remote from the substrate, a dye-receptive receiving layer to receive a dye thermally transferred from the donor sheet.

2. A receiver sheet according to claim 1 wherein the acrylic resin comprises from 50 to 100 mole % of at least one monomer derived from an ester of acrylic acid and/or an ester of methacrylic acid and/or derivatives thereof.

3. A receiver sheet according to claim 1 wherein the acrylic resin comprises an alkyl acrylate and an alkyl methacrylate.

4. A receiver sheet according to claim 1 wherein the acrylic resin comprises a terpolymer of methyl methacrylate/ethyl acrylate/methacrylamide.

5. A receiver sheet according to claim 1 wherein the substrate comprises a polymeric softening agent.

6. A receiver sheet according to claim 5 wherein the softening agent comprises an olefine polymer.

7. A receiver sheet according to claim 5 wherein the softening agent is polypropylene.

8. A receiver sheet according to claim 5 wherein the softening agent is present in an amount from 2% to 30% by weight of the polyester substrate.

9. A receiver sheet according to claim 8 wherein the softening agent is present in an amount from 8% to 14% by weight of the polyester substrate.

10. A receiver sheet according to claim 5 which further comprises a dispersing agent.

11. A receiver sheet according to claim 1 wherein the substrate comprises a particulate inorganic filler.

12. A receiver sheet according to claim 11 wherein the particulate inorganic filler is titanium dioxide.

13. A receiver sheet according to claim 1 wherein the receiving layer comprises a polyester resin.

14. A receiver sheet according to claim 1, wherein the deformation index ranges from 4.5% to 30%.

15. A receiver sheet according to claim 14, wherein the deformation index ranges from 5% to 20%.

16. A receiver sheet according to claim 15, wherein the deformation index ranges from 6% to 10%.

17. A method of producing a thermal transfer printing receiver sheet for use in association with a compatible donor sheet, which comprises forming an opaque polyester supporting substrate having a deformation index, at a temperature of 200° C. and under a pressure of 2 megaPascals, of at least 4.0%, coating on a surface of the substrate, an adherent layer coating composition comprising an aqueous dispersion of an acrylic resin, and providing on a surface of the adherent layer remote from the substrate, a dye-receptive receiving layer to receive a dye thermally transferred from the donor sheet.

18. A method according to claim 17 wherein the adherent layer coating composition is applied to the polyester substrate during stretching.

19. A thermal transfer printing receiver sheet for use in association with a compatible donor sheet, the receiver sheet comprising an opaque polyester supporting substrate having a deformation index, at a temperature of 200° C. and under a pressure of 2 megaPascals, of at least 4.0%, the substrate having, on a surface thereof, an adherent layer comprising an acrylic resin comprising 30 to 65 mole % of acrylate monomer and 20 to 60 mole % of methacrylate monomer, and having a coat weight within the range from 0.05 to 10 $mgdm^{-2}$, the adherent layer having, on a surface thereof remote from the substrate, a dye-receptive receiving layer to receive a dye thermally transferred from the donor sheet.

20. A thermal transfer printing receiver sheet for use in association with a compatible donor sheet, the receiver sheet comprising an opaque polyester supporting substrate comprising an effective mount of a polymeric softening agent, said substrate having a deformation index, at a temperature of 200° C. and under a pressure of 2 megaPascals, of at least 4.0%, the substrate having on a surface thereof, an adherent layer comprising an acrylic resin and having a coat weight within the range from 0.05 to 10 $mgdm^{-2}$, the adherent layer having, on a surface thereof remote from the substrate, a dye-receptive receiving layer to receive a dye thermally transferred from the donor sheet.

* * * * *